United States Patent [19]

Bohmrich et al.

[11] 4,114,389

[45] Sep. 19, 1978

[54] CONSTANT VOLUME BUOYANCY COMPENSATOR

[75] Inventors: Jack L. Bohmrich; William A. Bowden, Jr., both of Glenview; Vernon G. Pedersen, Chicago, all of Ill.

[73] Assignee: Dacor Corporation, Northfield, Ill.

[21] Appl. No.: 812,139

[22] Filed: Jul. 1, 1977

[51] Int. Cl.[2] ..... B63C 11/02

[52] U.S. Cl. ..... 405/186; 9/316

[58] Field of Search ..... 61/69 R, 70, 69 A; 9/311, 314, 316; 114/16 E

[56] References Cited

U.S. PATENT DOCUMENTS

| | | | |
|---|---|---|---|
| 3,379,023 | 4/1968 | Crose | 61/70 |
| 3,820,348 | 6/1974 | Fast | 61/70 |
| 3,964,266 | 6/1976 | Bartlett | 61/70 |
| 4,009,583 | 3/1977 | Buckle | 61/70 |

*Primary Examiner*—Mervin Stein
*Assistant Examiner*—David H. Corbin
*Attorney, Agent, or Firm*—Edmond T. Patnaude

[57] ABSTRACT

A diver's buoyancy compensator employs a constant volume chamber which is controllably pressurized with air from the diver's SCUBA tank, and water is admitted to or emitted from the tank by one or the other of two manually operated valves.

10 Claims, 10 Drawing Figures

CONSTANT VOLUME BUOYANCY COMPENSATOR

The present invention relates in general to controlled buoyancy compensation systems for use in SCUBA diving, and it relates in particular to a new and improved constant volume system which maintains a constant buoyancy compensation irrespective of changes in the depth of the diver.

BACKGROUND OF THE INVENTION

Buoyancy control systems as used in SCUBA diving generally employ a collapsible bag carried by the diver and into which air is supplied to inflate the bag and increase the buoyancy of the diver. A major disadvantage of these systems is that the buoyancy compensation provided by the bag changes as the depth thereof changes unless air is supplied to or removed from the bag. For example, as the diver descends, the bag contracts under the increased ambient pressure and thus displaces less water and provides less buoyancy compensation. The reverse is true as the diver ascends. Consequently, when using such prior art systems the diver is frequently required to supply air to or release air from the bag in order to maintain his buoyancy relatively constant.

In U.S. Pat. No. 3,161,028 there is described a buoyancy control system using a constant volume tank into which water is admitted or expelled to adjust the buoyancy thereof. In the system described in the said patent the pressure in the tank is maintained within 2 p.s.i. of the ambient by means of a pair of check valves. The one of the two check valves which opens when the tank pressure falls more than 2 p.s.i. below ambient pressure is connected to the line between the conventional demand regulator and the mouthpiece through which the diver normally breathes while under water. An inherent danger in using this system is that should the diver descend with the mouthpiece in his mouth, the substantial pressure differential between the ambient and his internal cavities connected to the mouthpiece is extremely dangerous. Other problems associated with the said patented system are one, he cannot increase his buoyancy while he is in an inverted position, two, the time required to initially fill the tank with water is relatively long, and three, should the diver exhaust his main air supply, he cannot use the system to increase his buoyancy by any substantial amount to enable him to get to the surface as soon as possible.

SUMMARY OF THE INVENTION

Briefly, there is provided in accordance with the present invention a constant volume buoyancy compensating system having a short response time to a demand by the diver for increased or decreased buoyancy irrespective of his orientation, which is relatively safe to use, and which is dependable in operation. This system employs a rigid tank having a constant volume chamber connected through a hand held valve and an elongated flexible hose to the ambient or to output of the first stage regulator of the SCUBA system of the diver. Second and third manually operated valves are respectively provided at the top and bottom of the tank for admitting or releasing water to or from the tank to adjust the buoyancy thereof, these latter valves also being automatic pressure relief valves which prevent exploding of the tank.

BRIEF DESCRIPTION OF THE DRAWINGS

Further objects and advantages and a better understanding of the present invention can be had by reference to the following detailed description, wherein.

DETAILED DESCRIPTION OF THE INVENTION

Figure 1:
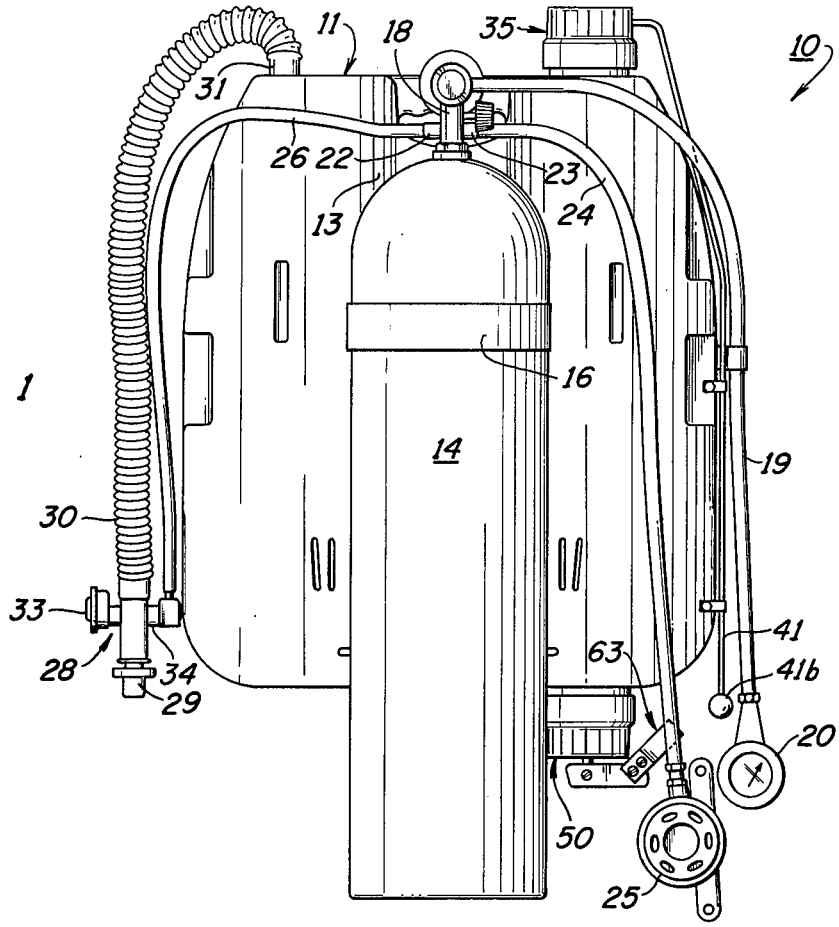
FIG. 1 is a rear elevational view, of a buoyancy compensator embodying the present invention.

Referring now to the drawings and particularly to FIGS. 1 through 4, a buoyancy compensator 10 for use in conjunction with a self-contained underwater breathing system includes a tank 11 formed of a rigid plastic material such, for example, as linear polyethylene. The tank 11 has a concave front surface 12 contoured to fit the back of the diver. The rear side of the tank 11 has a vertically elongated recess 13 which is adapted to receive a pressure cylinder 14 containing pressurized air for use by the diver in breathing under water.

The tank 11 is adapted to be strapped onto the back of the diver and the cylindrical air vessel 14 is strapped to the tank by suitable means such, for example, as the metal strap 16. The tank 11 is hollow and defines therein a sealed buoyancy chamber 17 which is symmetrical with respect to the vertical centerline of the tank.

The underwater breathing system with which the tank 11 is adapted to be used is conventional and includes a pressure regulator 18 mounted to the top of the tank 14 for reducing the tank pressure to an intermediate pressure of, for example, 110 p.s.i. The regulator 18 has three outlet ports at the intermediate pressure. One of these is connected through a flexible hose 19 to a pressure guage 20 to enable the diver to know the pressure within the tank 14 and thus the amount of air which remains therein. Two intermediate pressure outlets from the regulator 18 are identified in FIG. 1 as 22 and 23. The outlet 23 is connected by a conventional flexible conduit 24 to a demand regulator 25 which includes a mouthpiece (not shown) which the diver normally carries in his mouth while under water. When the diver inhales the demand regulator 25 opens to supply air to the diver. When the diver exhales the valve between the regulator 25 and the conduit 25 closes and air is exhausted from the regulator through suitable check valves therein.

The intermediate pressure outlet port 22 is connected by a flexible hose 26 to a control valve mechanism 28 which includes a mouthpiece 29 and a convoluted flexible hose 30 connected between the valve mechanism 28 and an air port 31 opening into the top of the chamber 17. The valve mechanism 28 includes a manual valve actuator 33, which, when depressed, opens a valve 34 to connect the line 26 to the flexible hose 30. The mouthpiece 29 includes a suitable valve which is opened by depressing the mouthpiece toward the body of the valve 28 thereby to open the mouthpiece and the hose 30 to the ambient. It may thus be seen that the buoyancy chamber is pressurized by activating the button 33. Pressure is released by depressing the mouthpiece 29. The valve 34 is more fully described in copending application Ser. No. 797,198, filed on May 16, 1977 and automatically operates to prevent implosion of the tank 11.

An automatic pressure relief valve 35 is mounted to the top of the tank 11 on the side opposite the port 31 and is in communication with the top of the chamber 17 in the tank 11. The valve 35 can be manually opened by means of a control rod 41 to adjust the buoyancy of the system. The details of the valve 35 are best shown in FIG. 9.

Figure 9:
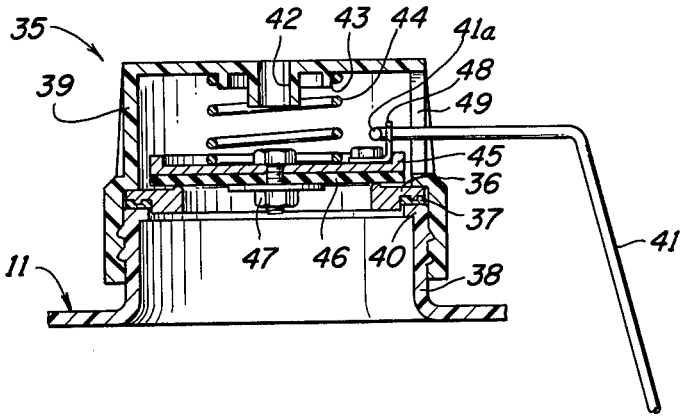
FIG. 9 is a cross-sectional view of the automatic pressure relief and manually operable valve positioned at the top of the buoyancy compensator of FIG. 1.

With reference to FIG. 9, the valve 35 comprises an annular valve seat member 36 which includes a gasket 37 which seats on the end of a neck 38 on the tank 11. A cap member 39 is threaded onto the neck 38 and holds the valve seat 36 against the reentrant flange 40 on the neck 38. The cap 39 is provided with a central opening 42 surrounded by a boss 43 which provides a seat for a compression coil spring 44 compressed between the inner upper surface of the cap 39 and a circular valve member 45. A sealing disc 46 is fastened to the underside of the valve member 45 by means of a nut and bolt 47 and is biased into sealing engagement with the seat member 36 by means of the spring 44. The spring 44 preferably maintains the valve in closed sealing condition until the pressure differential thereacross is about 2 p.s.i. or greater. When the pressure within the tank is 2 p.s.i. or more greater than the ambient the valve member compresses the spring 44 to relieve the pressure within the tank.

Figure 2:
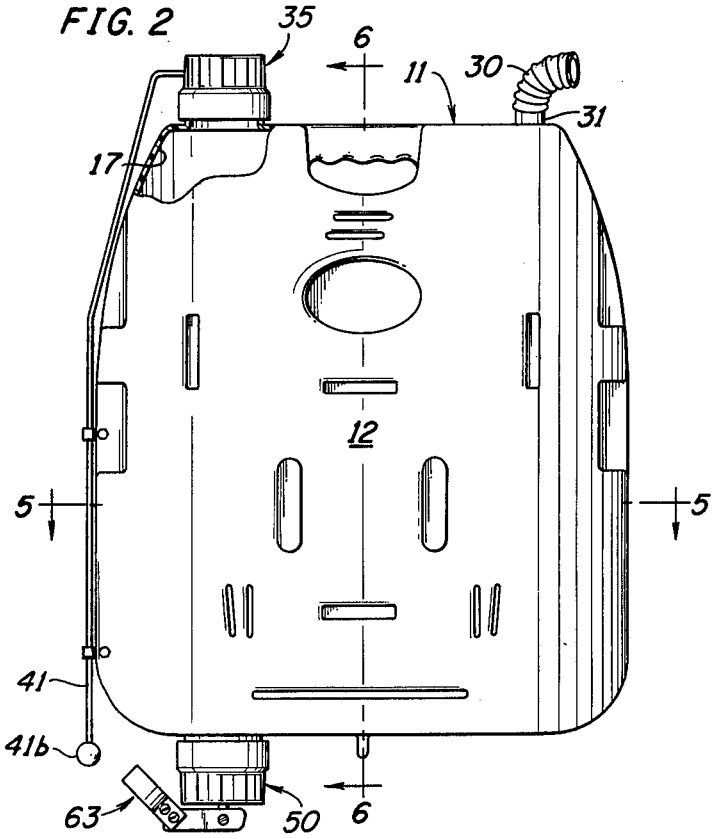
FIG. 2 is a front elevational view, partly in cross-section of the buoyancy compensator of FIG. 1.
Figure 3:
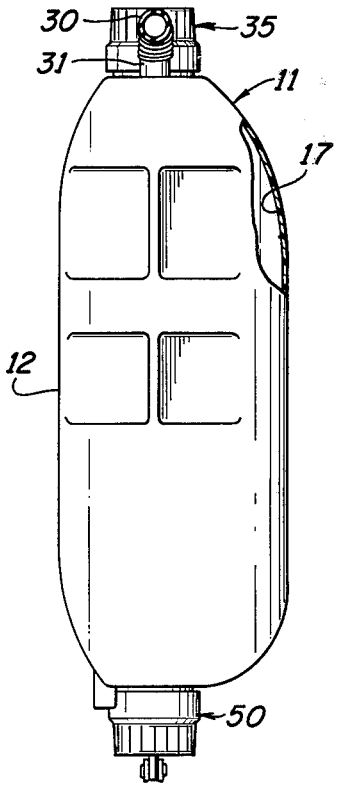
FIG. 3 is a side elevational view of the buoyancy compensator of FIG. 1.
Figure 4:
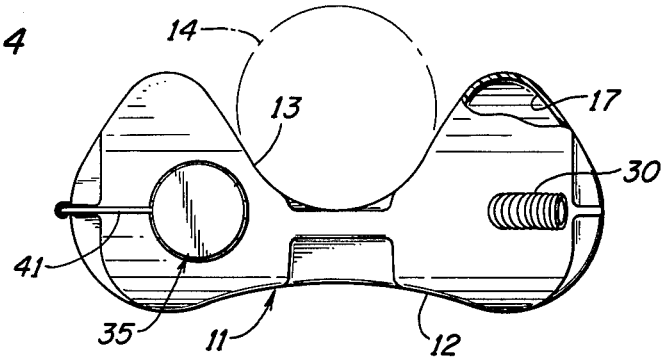
FIG. 4 is a top view of the buoyancy compensator of FIG. 1.

In order to permit the diver to manually open the valve 35 an L-shaped bracket 48 is secured to the valve member 45 and the upper end portion of the rod 41 extends through a slot 49 in the side wall of the cap 35 and is fastened to the bracket 48. In the illustrated embodiment of the invention the end portion of the rod 41 extends through a hole in the upstanding portion of the bracket and the end **41*a* of the rod is bent over to prevent inadvertent separation of the rod 41 from the bracket. As best shown in FIGS. 1 and 2 this rod is slidably mounted by clips along one side of the tank 11 and has a knob 41*b* at the bottom to facilitate actuation of the rod 41 by the diver by pushing upwardly on the knob the valve member 45 is moved against the force of the spring 44 away from the valve seal 36**.

Referring particularly to FIGS. 1 and 2, an automatic pressure relief and manually controlled water inlet-outlet valve 50 is mounted at the bottom of the tank 11. The details of the valve 50 are best shown in FIG. 10.

Figure 10:
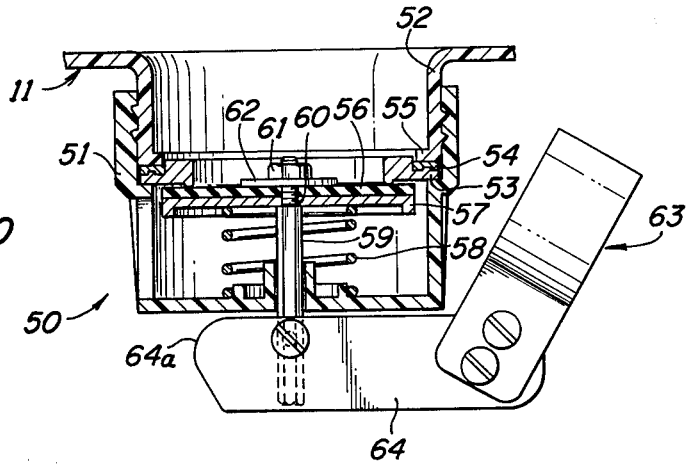
FIG. 10 is a cross-sectional view of the automatic pressure relief and manually operable valve positioned at the bottom of the buoyancy compensator of FIG. 1.

Referring to FIG. 10, the valve 50 is there shown in detail and may be seen to be similar in construction to the pressure valve of FIG. 9 with many of the parts being interchangeable. The manual water inlet-outlet valve 50 includes a cap member 51, identical in construction to the cap member 39, which is threaded onto a downwardly extending neck 52 on the tank 11. The cap 51 when secured in place holds a valve seat member 53 and its annular gasket 54 in sealing relationship with a reentrant flange 55 at the distal end of the neck 52. A valve disc 56 is mounted to a circular valve member 57 and is biased into sealing relationship with the seat 53 by means of a compression spring 58. A handle 63 assembly is attached to a valve rod 59 having a threaded upper end 60 which extends through the central apertures in the valve member 56 and 57, and a nut 61 is threaded thereon over washer 62 to secure the valve members together and to the valve rod 59. The spring 58 has the same spring constant as the spring 44 and will automatically permit the valve member 56 to move away from the seat 53 to relieve the pressure within the tank chamber 17 if the pressure differential is 2 p.s.i. or more.

In order to facilitate the manual operation of the valve 50 by the diver, the handle assembly includes a cam operating member 64 which is pivotally attached to the downwardly extending end of the valve stem 59. A cam surface **64*a* is provided at the upper distal corner of the member 64 for engagement with the lower face of the cap 51 when the handle 63 is pushed downwardly. Since the cam surface 64*a* is closer to the pivot point than is the handle 63, a mechanical advantage is provided. The angle between the handle 63 and the member 64** may be adjusted by the diver to that position which is most comfortable.

Figure 5:
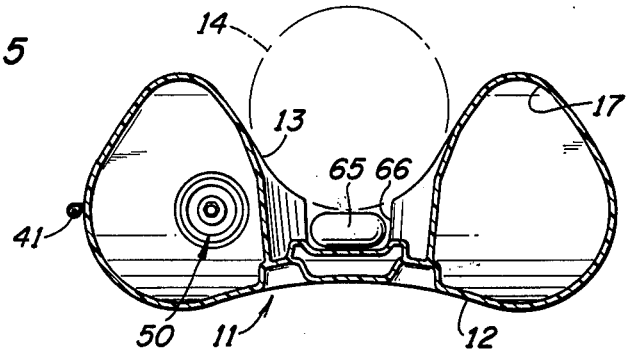
FIG. 5 is a cross-sectional view taken along the line 5—5 of FIG. 2.
Figure 6:
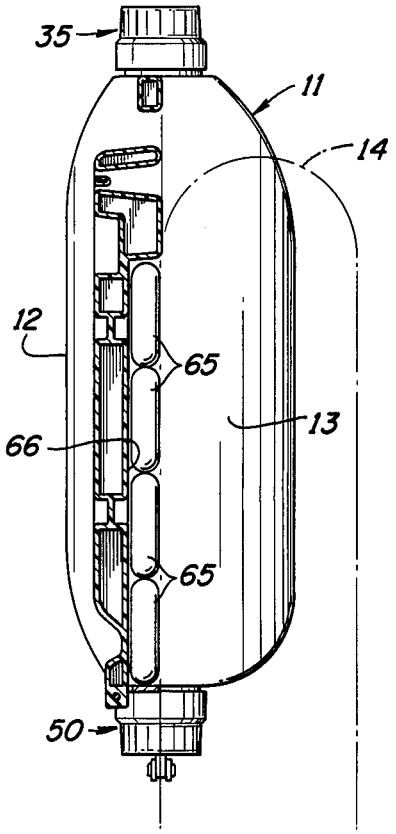
FIG. 6 is a cross-sectional view taken along the line 6—6 of FIG. 2.
Figure 7:
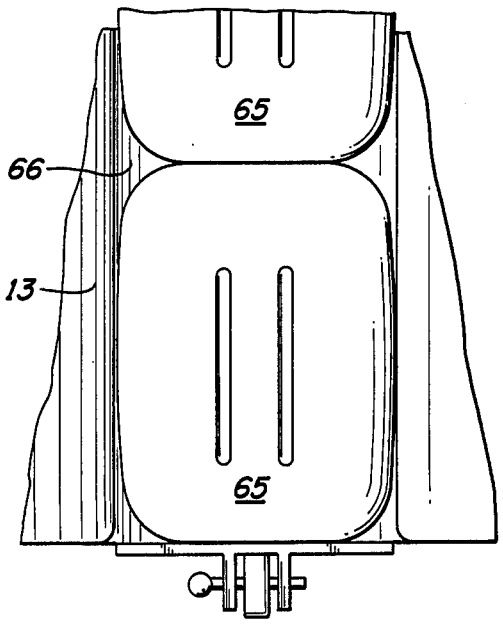
FIG. 7 is an enlarged view of the weight chute of the buoyancy compensator of FIG. 1.
Figure 8:
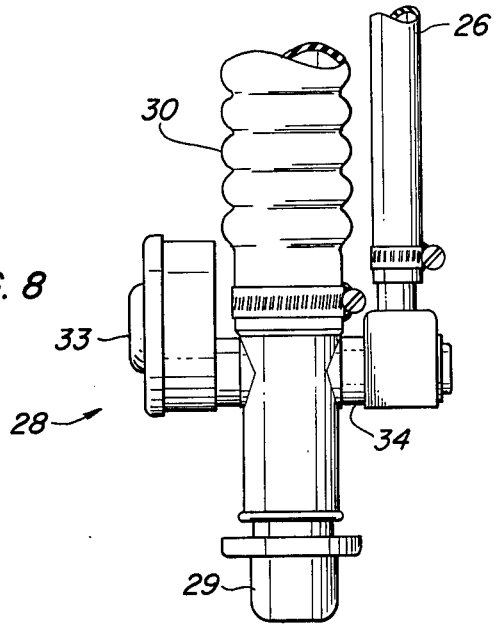
FIG. 8 is a view, partly in section, of the air control valve of the buoyancy compensator of FIG. 1.

For emergency use only in order to quickly increase the overall buoyancy of the diver and his equipment, a plurality of lead weights 65 are arranged one above the other in a chute 66 at the rear side of the tank 11. As best shown in FIG. 5, the weights 65 are held in place by the tank 14 which defines one wall of the rectangular chute in which the weights 65 are disposed. The forward and side walls of the chute are defined by the tank itself. A manually operated release latch is provided at the bottom of the chute so that in the event of emergency the diver can trip the latch and thereby permit the weights 65 to slide downwardly out of the chute.

OPERATION

In use, the diver first straps the pack to his back and enters the water. He then holds the mouthpiece operated valve 59 open above the water surface and pushes the valve handle 63 downwardly to open the valve 50 and permit water to enter the tank. As water enters the tank it displaces the air therein which exits through the emergency mouthpiece 29. The diver may open the valve 35 at this time to permit air to exit the tank. As water enters the tank, the tank and the diver are automatically shifted into an upright position. When a condition of neutral buoyancy exists the diver may descend simply by holding the valve 50 open and either the valve 28, the valve 35 or both open. By holding the valve 28 above his head a maximum pressure differential between the valves 28 and 50 is provided. Another way in which the diver may descend is simply to release the valve 28 and swim downwardly. Preferably the diver also actuates the valve 34 and holds it actuated to supply air pressure to the tank until such time as one of the relief valves 35 and 50 pops open. He then releases the actuator 33 knowing that there is approximately 2 p.s.i. of air in the tank 11. Should he thereafter wish to increase his buoyancy while he is in an upright position, the diver simply pushes down on the handle 63 to open the valve 50 and water is expelled through the valve 50 to the ambient. If, on the other hand, the diver wishes to increase his buoyancy while in an upright position he first depresses the valve 28 to relieve the pressure within the tank 11 and he than opens the valve 50. The rate at which water flows into the tank is, of course, dependent on the pressure differential between the valve 50 and the opening in the mouthpiece 29. Therefore, in order to rapidly increase the negative buoyancy of the compensating system the diver may hold the valve assembly 28 in an extended position over his head whereby the pressure differential between the valve 50 and the opening of the mouthpiece 29 is equal to about the head of four feet of water. In order to increase the negative buoyancy of the compensator while the diver is in an inverted or head down position he may open the valve 35 and either or both of the valves 28 and 50 to relieve the pressure within the tank and admit water thereto.

A particular advantage of the present invention over the flexible bag type compensators is that once set, the buoyancy compensation of the compensator remains fixed irrespective of the ambient pressure or depth of the diver. Moreover, when cave diving or when diving in confined areas, the diver can control his buoyancy irrespective of whether he is in a head up or head down position. Another advantage of this system is that it is comfortable to wear, does not interfere with the normal under water activities and is not a part of the under water breathing system whereby failure of the compensator does not affect the normal breathing of the diver. Importantly, the mouthpiece of the scuba system is not connected to the compensator whereby the pressure in the tank 11 is completely unrelated to the ability of the diver to use his normal self contained breathing system.

In the event the diver runs out of air while on the bottom, he does not have to worry about kicking frantically to reach the surface. Since the average diver uses only about one-half to two-thirds of the chamber filled with water to obtain neutral buoyancy, there will always be air contained within the chamber. All the diver has to do is open the water inlet valve 50 and kick once or twice towards the surface. With the diver already in a neutrally buoyant state, this will be easy to do. As the outside water pressure decreases, the volume of air inside the tank will increase and begin to displace the water in the chamber. As the water leaves the unit, the diver's buoyancy becomes more positive and the diver begins to ascend.

When the desired ascent rate has been reached, he closes the water inlet valve 50 so the ratio of air to water contained within the chamber will stabilize and become constant, and the proper rate of ascent will be maintained. The excess air will be vented through the automatic overpressure relief valve 35 as the diver ascends, keeping the ratio and the ascent rate constant.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. An underwater buoyancy compensator for use by divers, comprising a buoyancy tank adapted to be carried by a diver and having therein a sealable chamber of constant volume, gas inlet valve means connected between said chamber and a source of gas under pressure, first pressure relief valve means mounted at the top of said tank for connecting the top of said chamber to the ambient when the pressure across said first valve means exceeds a predetermined amount, second pressure relief valve means mounted at the bottom of said tank for connecting the bottom of said chamber to the ambient when the pressure across said second valve means exceeds a predetermined amount, first manually operable means connected to said first pressure relief valve means for enabling the diver to manually open said first valve means, and second manually operable means connected to said second pressure relief valve means for enabling the diver to manually open said second valve means.

2. An underwater buoyancy compensator according to claim 1, comprising a first elongated flexible conduit connected between said source of gas and said gas inlet valve means, a second elongated flexible conduit connected between said gas inlet valve means and said chamber, and said gas inlet valve means incorporating a manually operable valve for connecting said second flexible conduit to the ambient.

3. An underwater buoyancy compensator according to claim 2 wherein said first and second manually operable means are located in proximity to the bottom of said buoyancy tank.

4. An underwater buoyancy compensator according to claim 3 wherein said second manually operable means comprises a cam operating means providing a mechanical advantage for facilitating the manual opening of said second valve means.

5. An underwater buoyancy compensator according to claim 2, wherein said second elongated flexible tube is connected to the top of said chamber.

6. An underwater buoyancy compensator according to claim 1, wherein said first and second pressure relief valve means both operate at substantially the same predetermined pressure differential thereacross.

7. An underwater buoyancy compensator according to claim 1 wherein said first and second manually operable means are located in proximity to one another and to the bottom of said tank to permit the actuation of both valves by one hand of the diver.

8. An underwater buoyancy compensator according to claim 7 wherein said first manually operable means comprises a rod slidably mounted to the side of said tank and extending from said first pressure relief valve means to a location in proximity to the bottom of said tank.

9. An underwater buoyancy compensator according to claim 7 wherein both said first and second manually operable means are moved in opposite directions to open the respective valves.

10. An underwater buoyancy compensator according to claim 1 wherein said second manually operable means opens said second pressure relief valve means in response either to a downward push or an upward pull thereon by the diver.

* * * * *